US012790815B2

(12) United States Patent
Murphy et al.

(10) Patent No.: US 12,790,815 B2
(45) Date of Patent: Nov. 10, 2026

(54) STAIRCASE CASSETTE LEDGER CONNECTOR

(71) Applicant: Simpson Strong-Tie Company Inc., Pleasanton, CA (US)

(72) Inventors: Timothy Patrick Murphy, Tracy, CA (US); Sam Thomas Hensen, Pleasanton, CA (US)

(73) Assignee: Simpson Strong-Tie Company Inc., Pleasanton, CA (US)

( * ) Notice: Subject to any disclaimer, the term of this patent is extended or adjusted under 35 U.S.C. 154(b) by 228 days.

(21) Appl. No.: 18/197,016

(22) Filed: May 12, 2023

(65) Prior Publication Data

US 2023/0366196 A1 Nov. 16, 2023

Related U.S. Application Data

(60) Provisional application No. 63/342,016, filed on May 13, 2022.

(51) Int. Cl.
*E04B 1/38* (2006.01)

(52) U.S. Cl.
CPC ..... *E04B 1/388* (2023.08); *E04B 2001/389* (2023.08)

(58) Field of Classification Search
CPC ..... E04B 1/003; E04B 1/64; E04B 1/2608; E04B 1/2612; E04B 2001/2415; E04B 2001/2403; E04B 2001/2644; E04B 2001/389; E04B 1/2604; E04B 1/0038; E04B 1/388; E04B 5/12; E04B 5/14; E04B 2/8647; E04B 7/045; E04D 13/15; E04F 19/061
See application file for complete search history.

(56) References Cited

U.S. PATENT DOCUMENTS

| | | | | |
|---|---|---|---|---|
| 4,144,683 | A | 3/1979 | Dean | |
| 4,480,941 | A | 11/1984 | Gilb et al. | |
| 4,584,813 | A | 4/1986 | Hudson | |
| 4,717,279 | A * | 1/1988 | Commins | F16B 9/052 403/187 |
| 4,811,542 | A | 3/1989 | Jewell | |
| 4,866,894 | A * | 9/1989 | Brown | E04F 11/1041 52/182 |
| 4,953,339 | A | 9/1990 | Jewell | |

(Continued)

FOREIGN PATENT DOCUMENTS

| | | | |
|---|---|---|---|
| CA | 2911115 | C | 4/2022 |
| EP | 1672133 | A2 | 6/2006 |

(Continued)

OTHER PUBLICATIONS

Notification of Transmittal and Search Report and Written Opinion of the International Searching Authority for International Application PCT/US2023/022169, application part, Sep. 1, 2023, 16 pages, European Patent Office, NL.

(Continued)

*Primary Examiner* — Jonathan Liu
(74) *Attorney, Agent, or Firm* — Charles R. Cypher

(57) ABSTRACT

A connector that allows for the connection of a supported member to a supporting member and the supported member can be part of a prefabricated member such as a cassette, the connector having front and back members connected by a seat member.

20 Claims, 11 Drawing Sheets

(56) References Cited

U.S. PATENT DOCUMENTS

| | | | | | |
|---|---|---|---|---|---|
| 5,058,358 | A * | 10/1991 | Stratton | E04B 1/2612 52/704 |
| 5,071,280 | A | 12/1991 | Turner | |
| 5,205,093 | A * | 4/1993 | Schuette | E04F 11/025 52/182 |
| 5,274,981 | A | 1/1994 | Commins | |
| 5,419,649 | A * | 5/1995 | Gilb | F16B 9/058 403/231 |
| 6,397,552 | B1 | 6/2002 | Bourque | |
| 6,658,806 | B1 * | 12/2003 | Leek | E04B 1/41 52/715 |
| 6,817,157 | B2 | 11/2004 | Bourque | |
| 7,024,833 | B1 | 4/2006 | Rice | |
| 7,631,463 | B2 | 12/2009 | Greenlee et al. | |
| 7,958,690 | B2 * | 6/2011 | Leek | E04H 9/14 52/712 |
| 9,038,338 | B2 | 5/2015 | Rice | |
| 9,151,058 | B1 * | 10/2015 | Leathe | E04B 1/003 |
| 9,932,735 | B1 | 4/2018 | Biasucci et al. | |
| 10,024,046 | B2 | 7/2018 | Higginbotham | |
| D843,823 | S | 3/2019 | Bouchard | |
| 2005/0066613 | A1 | 3/2005 | Bourque | |
| 2005/0160683 | A1 | 7/2005 | Eldeen | |
| 2006/0130414 | A1 | 6/2006 | Walther | |
| 2009/0190996 | A1 | 7/2009 | Clarke | |
| 2020/0325671 | A1 * | 10/2020 | Holland | F16B 37/02 |
| 2021/0230858 | A1 * | 7/2021 | Daudet | E04B 1/2612 |

FOREIGN PATENT DOCUMENTS

| | | | | |
|---|---|---|---|---|
| GB | 2451686 | A | 2/2009 | |
| NL | 2010093 | | 7/2014 | |
| WO | WO-0053352 | A1 * | 9/2000 | B21D 11/10 |
| WO | WO 2025/207963 | A1 | 10/2025 | |

OTHER PUBLICATIONS

Strong-Drive SDWS/SDWH and LSC, catalog, 2017, pp. 342 and 344 and front and back cover, Wood Construction Connectors 2017-2018 C-C-2017, Simpson Strong-Tie Company Inc., USA.

Koel, Leonard, Staircase Construction, book, 1991, p. 568 and copyright p. Carpentry 2nd edition, American Technical Publishers, Inc., USA.

Under Floor Lateral Bracing, catalog, 1994, 1 page, Harlen Metal Products, Inc., USA.

* cited by examiner

STAIRCASE CASSETTE LEDGER CONNECTOR

BACKGROUND

This invention relates to a connector for joining structural members and the connection made therewith. In particular, the present invention has particular application as a simple, inexpensive hanger for strengthening a connection between a header and a ledger, and as a system for joining a prefabricated member such as a staircase cassette to a supporting header.

U.S. Pat. No. 7,024,833, granted in 2006 and invented by John Rice, teaches a simple hanger for connecting a ledger to a wall made with insulated foam forms.

U.S. Pat. No. 7,631,463, granted in 2009 and invented by Greg Greenlee et al, teaches a stair stringer hanger for attaching a sloped stair stringer to a ledger.

U.S. Pat. No. 7,958,690, granted in 2011 and invented by William F. Lee et al, teaches a connector that has gussets for angled fastener openings in a connector.

The present invention is a connector and connection made with that connector that allows for the quick attachment of a prefabricated member such as a staircase cassette or other type of cassette to a header.

SUMMARY OF THE INVENTION

The present invention provides a connector that allows for the easy installation of a ledger to a header, and in particular to a ledger that is part of a prefabricated member such as a staircase cassette.

The present invention provides a connector that can support a held member with respect to a holding member. The connector is preferably u-shaped with front and back members connected to each other at their bottom edges by a seat member with the front and back members extending upwardly from the seat member. Preferably, angled fasteners are used to attach the connector to the supported and supporting members. Additional fasteners are used that attach the back member of the connector to the supporting member.

In the preferred form of the invention, the angled fasteners are driven through the front member and are driven at an upward angle with the angled fasteners first entering and passing through the supported member and then entering the supporting member. Preferably, at least two angled fasteners are driven through the front member and enter the supporting member near the upper portion of the back member such that they bracket the upper portion of the back member.

The front and back members have portions that are generally planar. The seat member is generally planar. The back member preferably extends above the seat member much higher than the front member. When the connector is installed on a supporting member, the front and back members generally extend vertically, and the seat member extends horizontally.

The front member is preferably a generally rectangular member that is as wide as the seat member.

The back member preferably has a lower portion, a middle portion disposed upwardly from the seat member and above the lower portion, and an upper portion disposed above the middle portion. The lower portion of the back member is preferably as wide as the seat member. The upper portion of the back member is preferably much narrower than the seat member and the front member. The middle portion of the back member extends between the lower portion and the upper portion and tapers in width from the lower portion to the upper portion. Preferably, the bottom of the upper portion and the interface between the middle portion and the upper portion of the back member is disposed above the seat member a distance that is similar and just above the height of an upper edge of the front member.

The front member preferably is formed with an upper portion and a lower portion. The upper portion of the front member is preferably formed as a jutting lip flange, and the lower portion is formed as a generally planar member. The jutting lip flange has an upper edge.

The upper edge of the lower portion of the front member is connected to the jutting lip flange that extends outwardly and further away from the back member than the generally planar lower portion of the front member. The jutting lip flange is preferably a planar member that preferably extends outwardly at a 45-degree angle to the generally planar lower portion of the front member. The jutting lip flange is attached to the lower portion of the front member at an upper edge bend line of the lower portion of the front member.

Preferably, openings are provided in the front member, and openings are also provided in the back member.

At the interface between the jutting lip flange and the lower portion of the front member one or more gusset members are provided that extend between the jutting lip flange and the lower portion of the front member. The one or more gusset members have generally planar fastener receiving members that extend outwardly and away from the generally planar lower portion of the front member at an angle of approximately 22.5 degrees. An opening for receiving a fastener is preferably formed in each fastener receiving member.

The fastener receiving members of the gussets are preferably formed as rectangular members with upper and lower edges and right and left side edges. The upper edges of the fastener receiving members connect to the jutting lip flange and the lower edges of the fastener receiving members connect to the lower portion of the front member.

The one or more gussets are preferably formed with triangular left and right end portions that respectively connect the left and right side edges of the generally planar fastening receiving members to the jutting lip flange and the front member.

The front and back members and the seat member are preferably formed from metal and are integrally joined to each other and are formed by bending sheet steel to make the three-dimensional shape of the u-shaped connector.

The cassette is preferably formed with a ledger, an opposed end board, and rim side boards which are disposed at the periphery of the cassette. The cassette is provided with decking materials that are connected to the ledger, opposed end board and rim side boards. In the case of a staircase cassette the rim boards are made up of stair stringers. The stair stringers are preferably formed with a straight bottom surface while the opposed top surface is notched to form horizontal surfaces that will serve as tread support surfaces and vertical surfaces that will form riser surfaces between the tread surfaces. At the upper end of the stair stringer the stringer is cut to form a vertical rearward surface that will interface with or lie closely adjacent to the ledger board. At the lower end of the stair stringer the stinger is cut to form a horizontal downward facing surface that can support the staircase cassette.

DETAILED DESCRIPTION OF THE INVENTION

Figure 1:
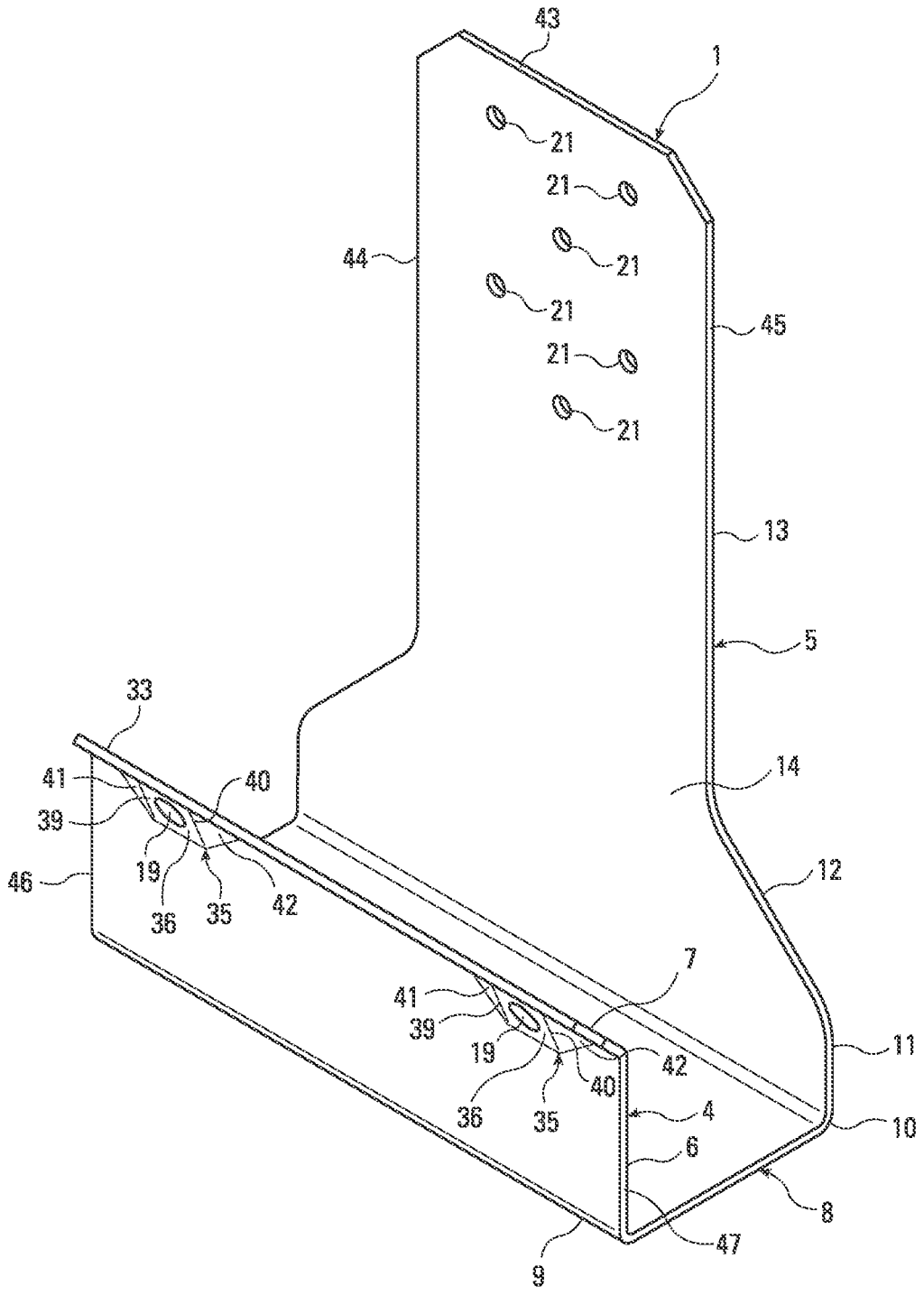
FIG. 1 is a perspective view of the connector of the present invention.
Figure 2:
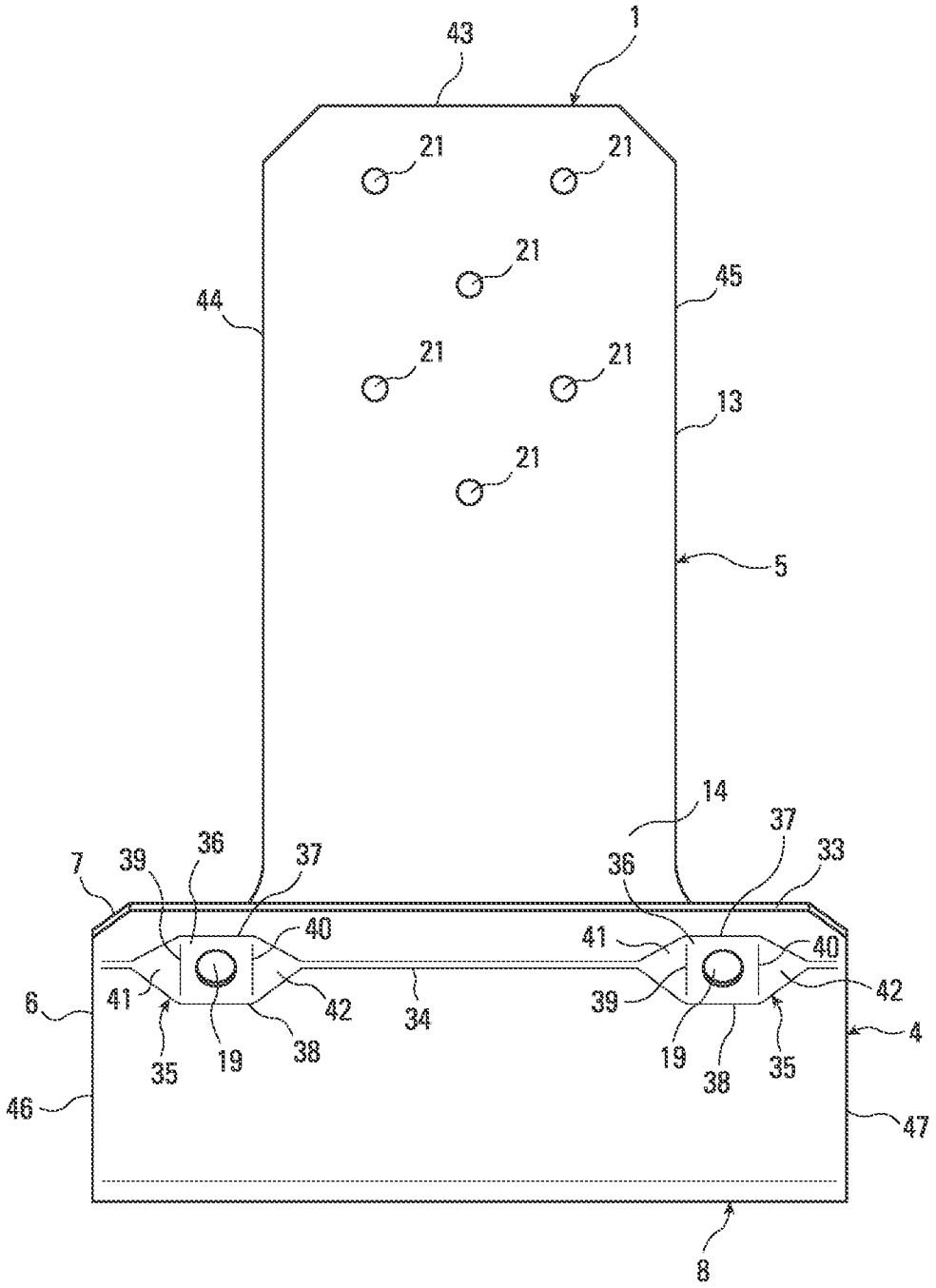
FIG. 2 is a front view of the connector of FIG. 1.
Figure 3:
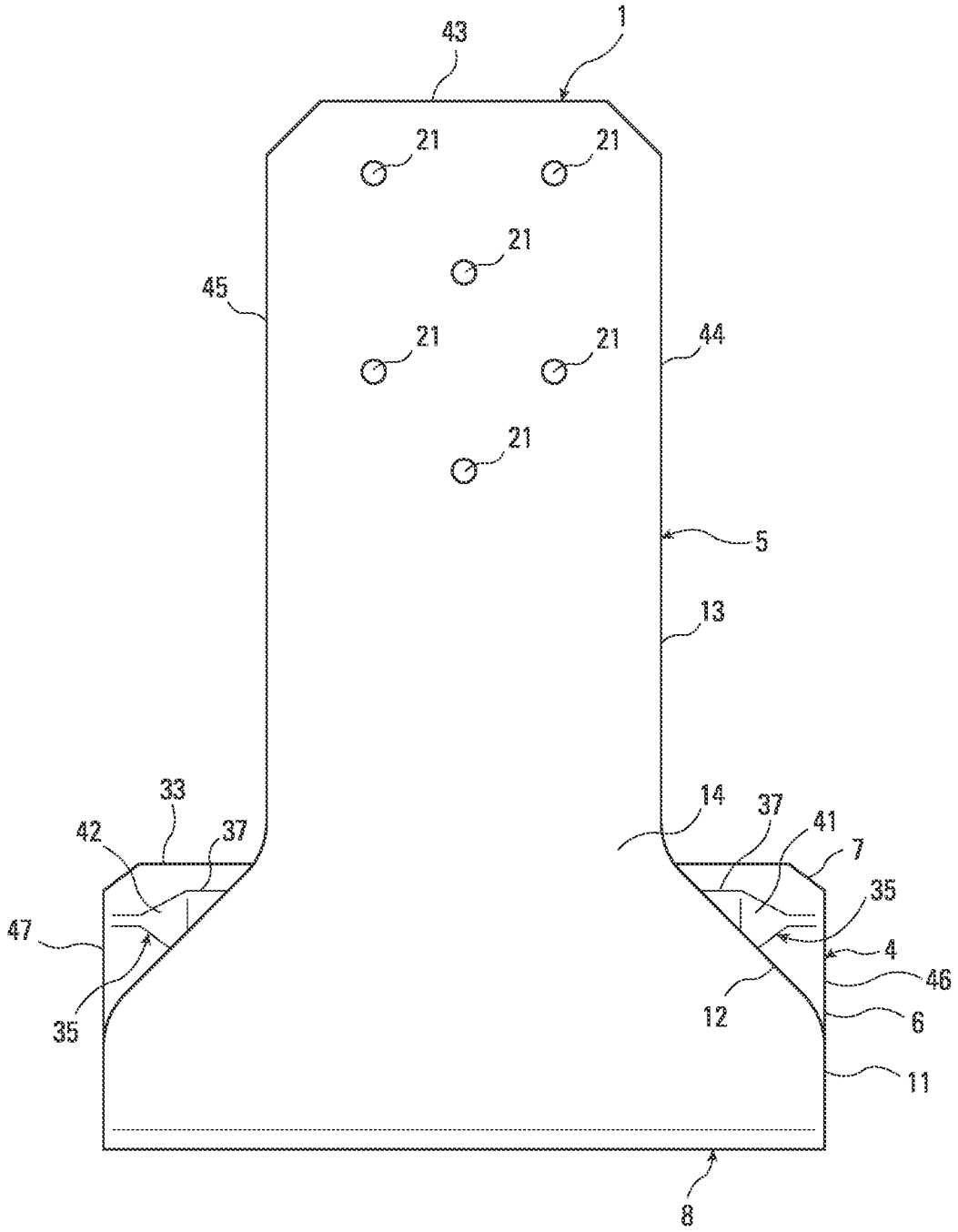
FIG. 3 is a back view of the connector of FIG. 1.
Figure 4:
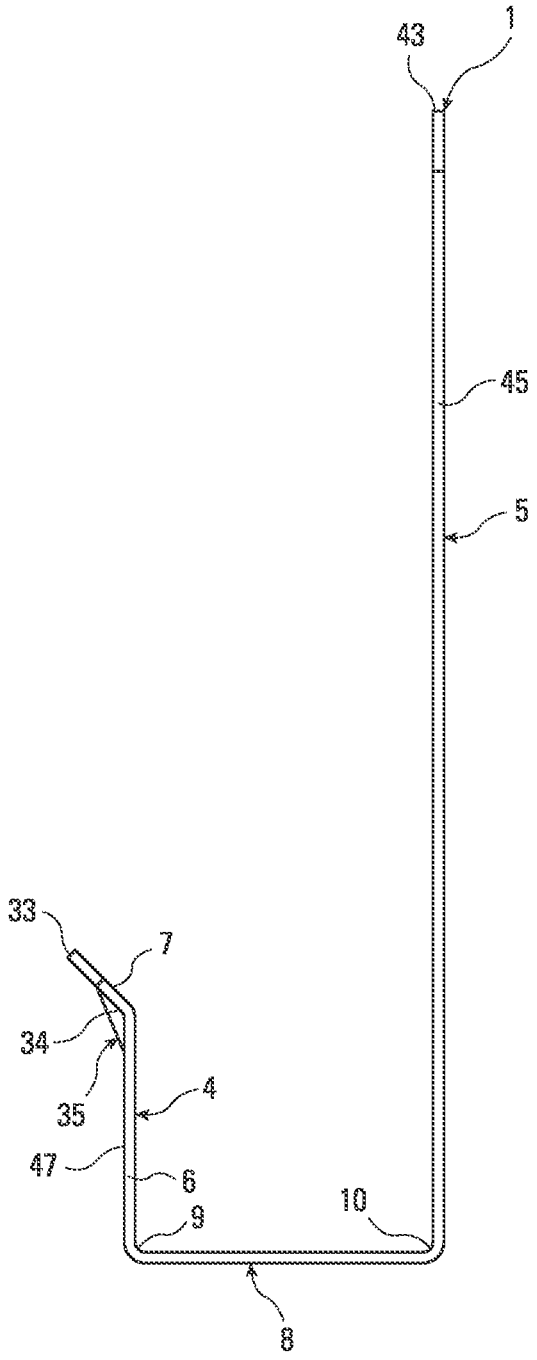
FIG. 4 is a right, side view of the connector of FIG. 1.
Figure 5:
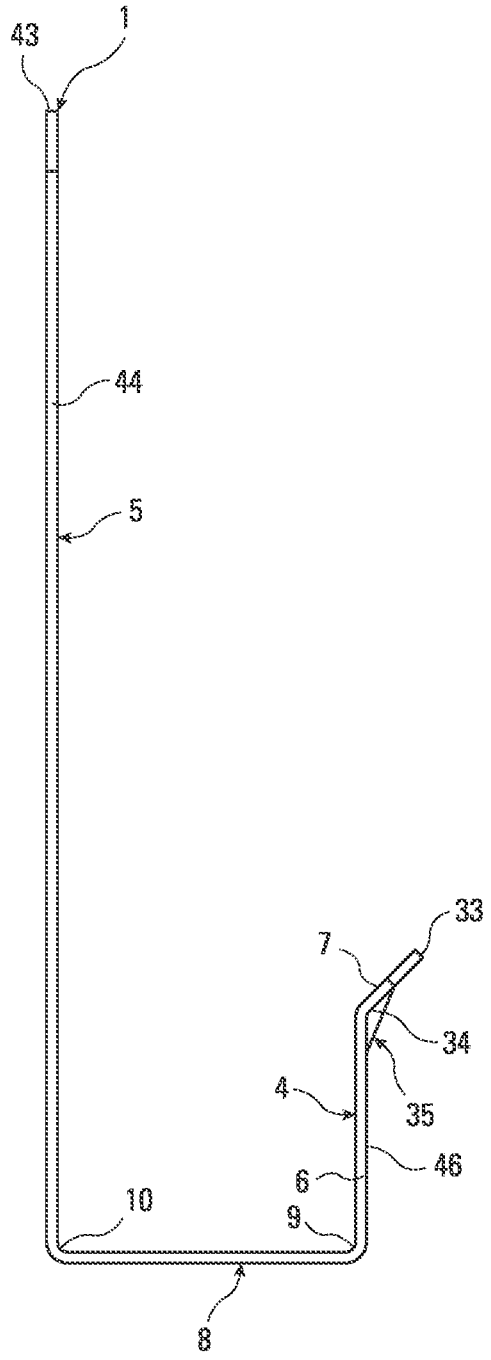
FIG. 5 is a left, side view of the connector of FIG. 1.
Figure 6:
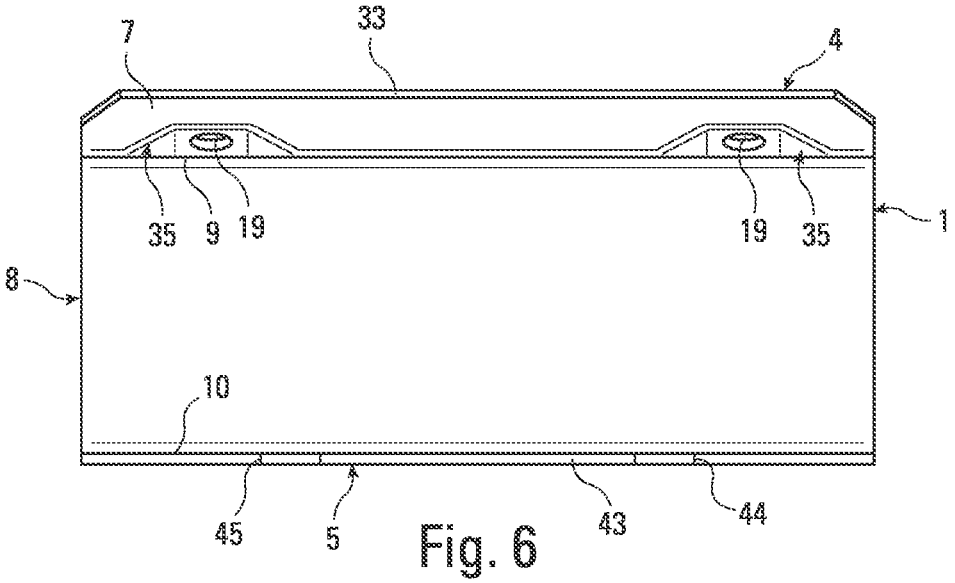
FIG. 6 is a top view of the connector of FIG. 1.
Figure 7:
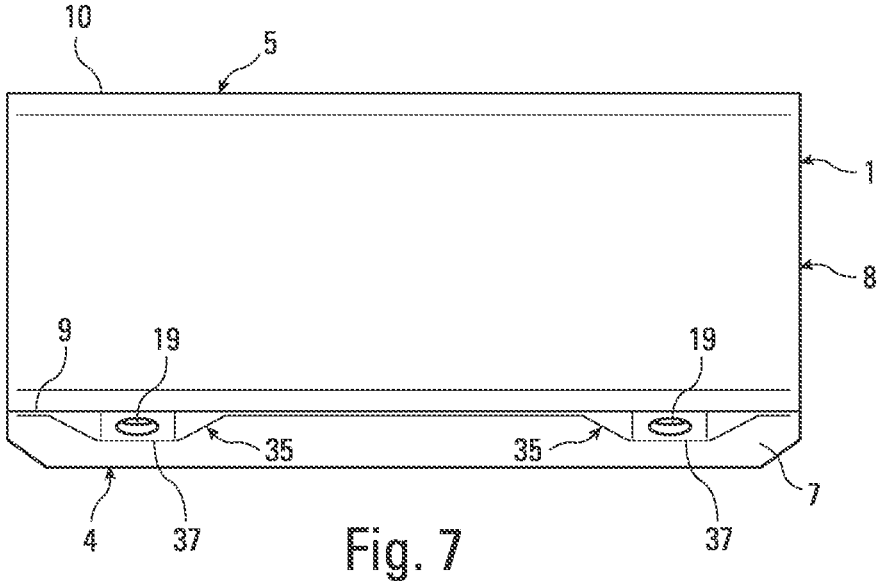
FIG. 7 is a bottom view of the connector of FIG. 1.

Referring to FIGS. 1 and 4 of the drawings, the connector or hanger 1 of the present invention is designed to attach a supported member 2 to a supporting member 3. The hanger 1 has a front member 4 and a back member 5. The front member is formed with a lower portion 6 and an upper portion 7. A seat member 8 connects the front member 4 and the back member 5 to create the U-shaped connector 1.

As shown in FIG. 1 the seat member 8 is an integral part of the front and back members 4 and 5 of the hanger 1. The seat member 8 is preferably connected to the front and back members 4 and 5 at the bottom of the front and back members 4 and 5. Preferably, the seat member 8 is a generally planar member. The seat member 8 is preferably connected to the front and back members 4 and 5 along parallel front and back seat bend lines 9 and 10. The seat member 8 is integrally connected to the front and back members 4 and 5 along the front and back seat bend lines 9 and 10. The front and back members 4 and 5 extend upwardly from the front and back seat bend lines 9 and 10, respectively. The front and back members 4 and 5 have portions that are generally planar. The seat member 8 is generally planar. The back member 5 preferably extends above the seat member 8 much higher than the front member 4. When the connector 1 is installed on a supporting member 3, the front and back members 4 and 5 generally extend vertically, and the seat member 8 extends horizontally.

The front member 4 is preferably a generally rectangular member that is as wide as the seat member 8.

The back member preferably has a lower portion 11, a middle portion 12 disposed upwardly from the seat member 8 and above the lower portion 11, and an upper portion 13 disposed above the middle portion 12. The lower portion 11 of the back member 4 is preferably as wide as the seat member 8. The upper portion 13 of the back member 4 is preferably much narrower than the seat member 8 and the front member 5. The middle portion 12 of the back member 4 extends between the lower portion 11 and the upper portion 13 and tapers in width from the lower portion 11 to the upper portion 13. Preferably, the bottom 14 of the upper portion 13 and the interface between the middle portion 12 and the upper portion 13 of the back member 5 is disposed above the seat member 8 a distance that is similar or just above the height of the front member 5.

Figure 12:
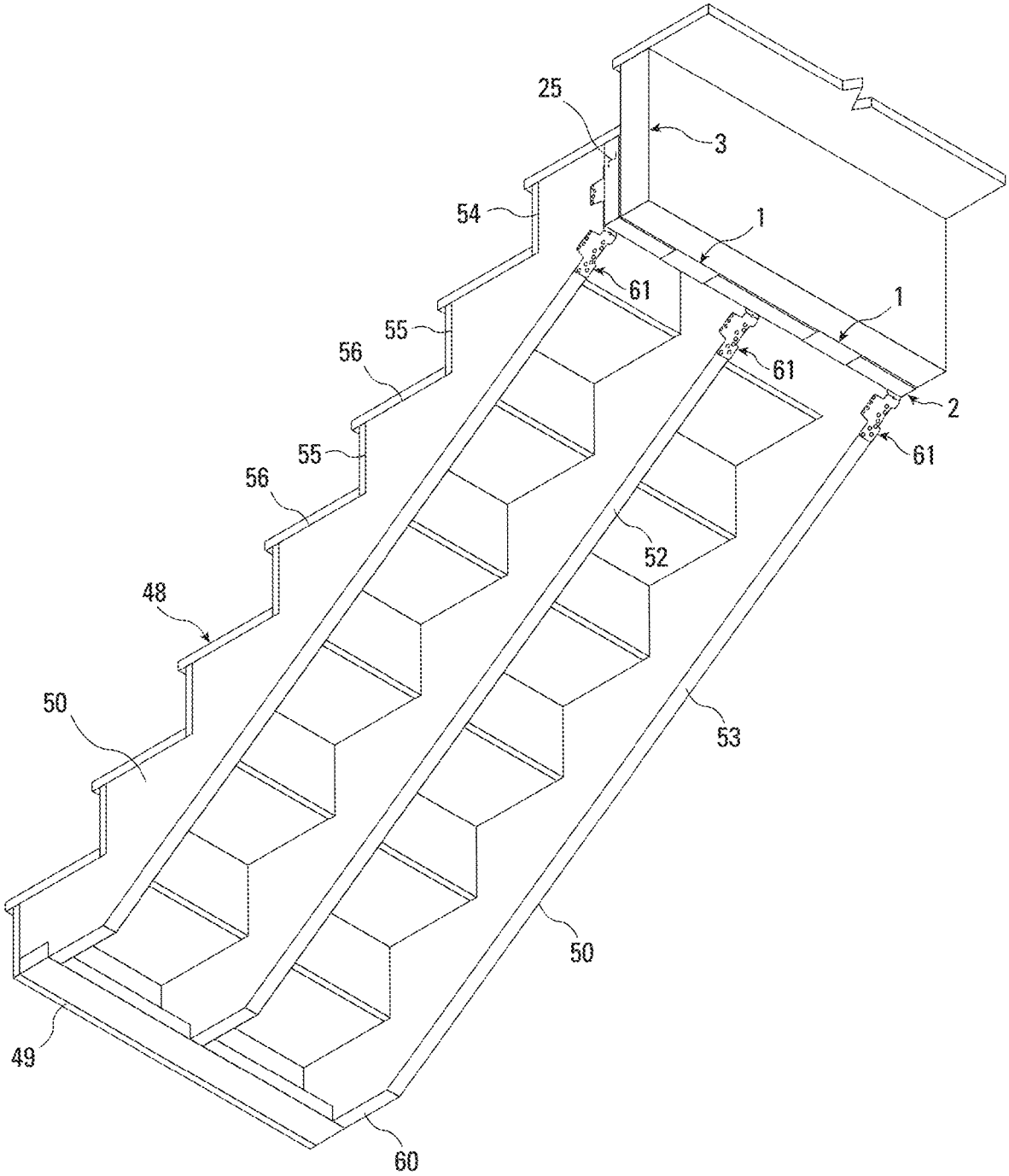
FIG. 12 is a bottom perspective view of the connection of the present invention, showing the entire staircase cassette.

Preferably, angled fasteners 15 are used to attach the connector 1 to the supported and supporting members 2 and 3. As shown in FIG. 12, the angled fasteners 15 driven through the front member 4 can be driven at an upward angle with the angled fasteners 15 first entering and passing through the supported member 2 and then entering the supporting member 3. Preferably, at least two angled fasteners 15 are driven through the front member 4 and enter the supporting member 3 near the upper portion 13 of the back member such that they bracket the upper portion 13 of the back member 4.

The angled fasteners 15 are preferably formed with a shank 16 having an end portion 17 and a middle portion 18. The end portion 17 of the shank 16 of the fastener 15 is embedded in the supporting member 3 and the middle portion 18 of the shank 16 of the fastener 15 is embedded in the supported member 2. The fasteners 15 shown are screws, but nails and other similar fasteners may be used.

The connector 1 is preferably formed with fastener openings 19 to aid the user in positioning and driving the angled fasteners 15 that make the attachment.

Preferably, additional fasteners 20 attach the back member 5 of the connector 1 to the supporting member 3. The back member 5 of the connector 1 is preferably formed with openings 21 for these fasteners 20 which are preferably nails.

Figure 8:
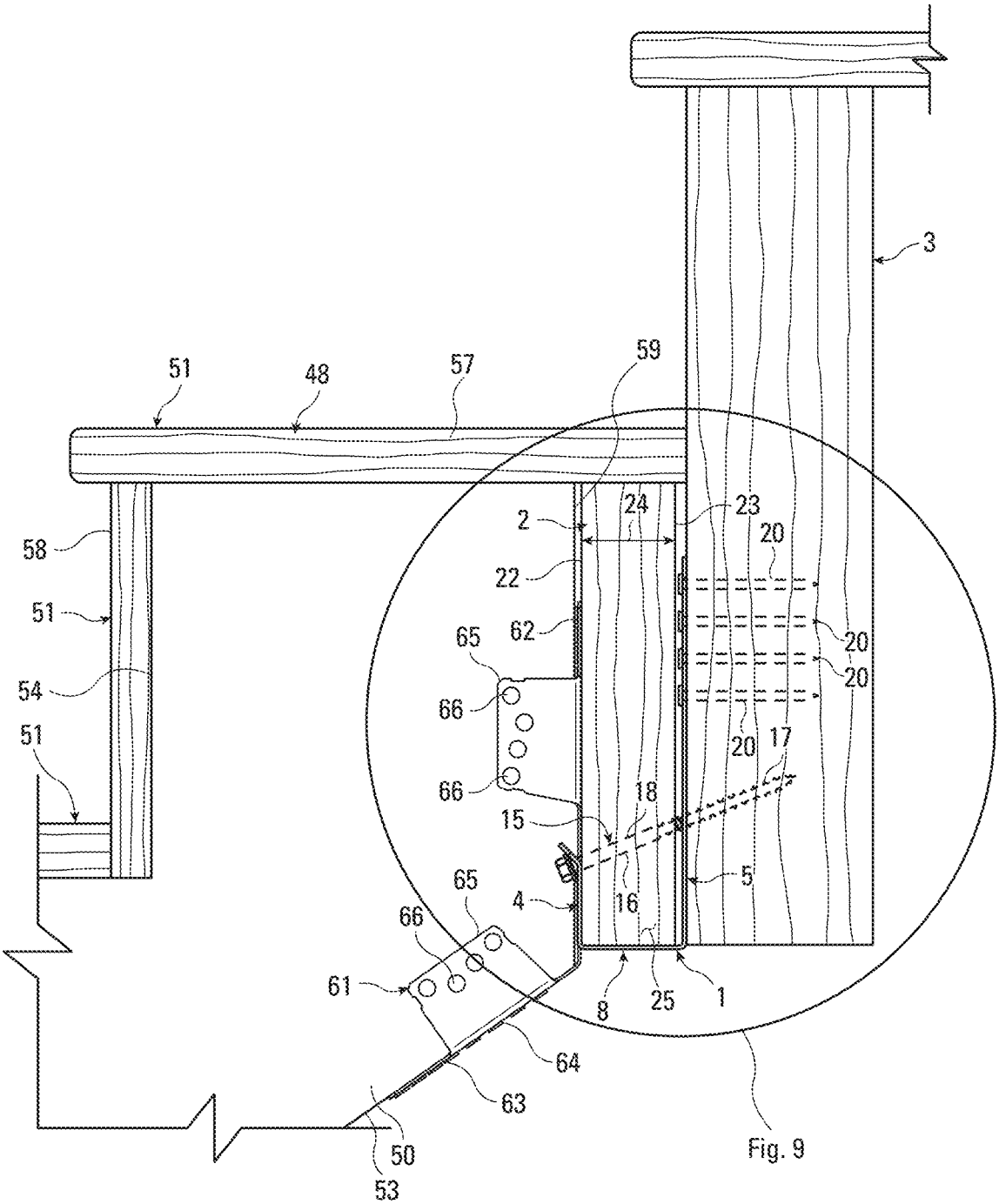
FIG. 8 is right, side view of the connection of the present invention with additional fasteners connecting the ledger board to the header not being shown.
Figure 9:
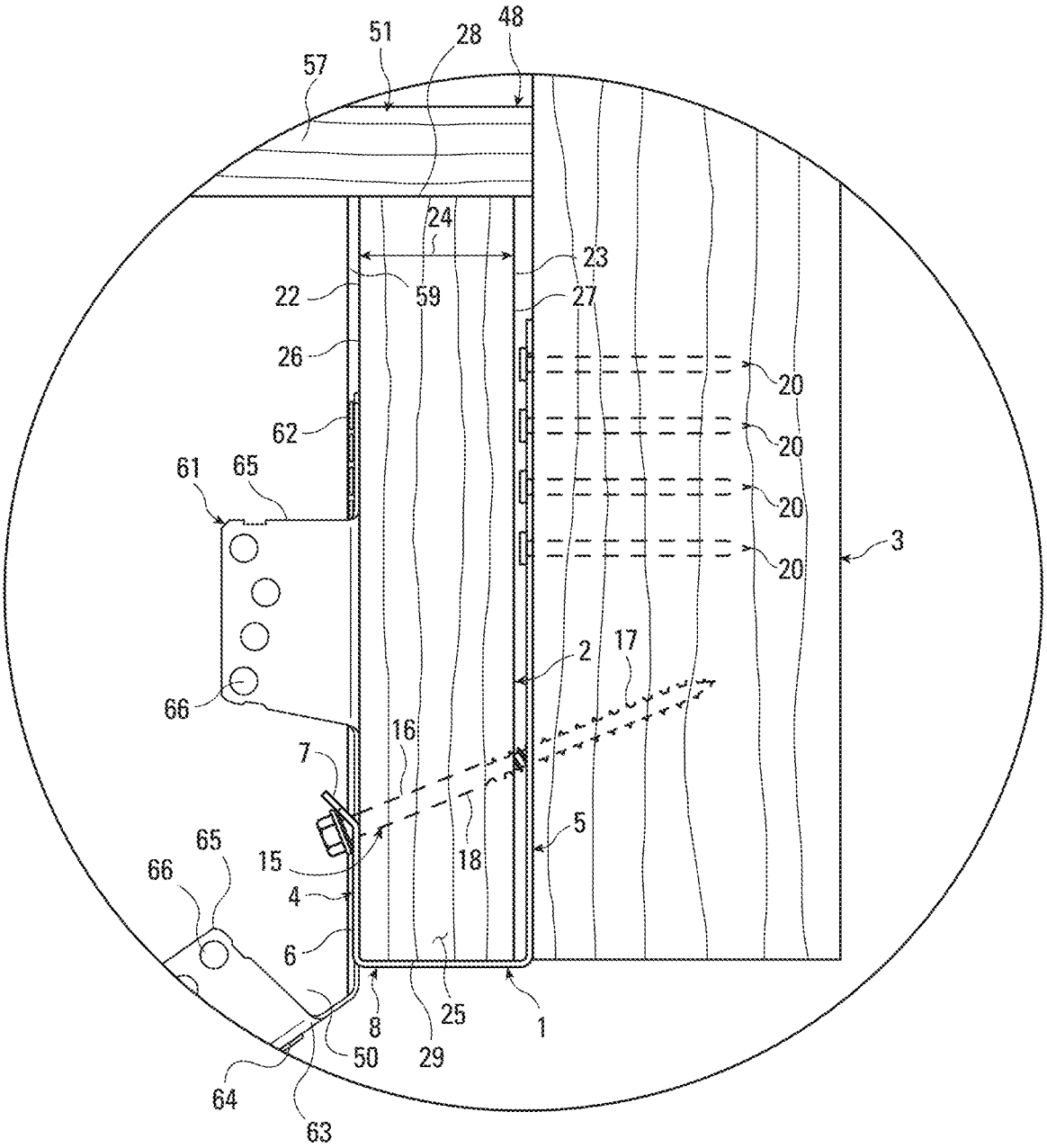
FIG. 9 is an enlarged, right, side view of the connection of the present invention, taken along the view line shown in FIG. 8.
Figure 11:
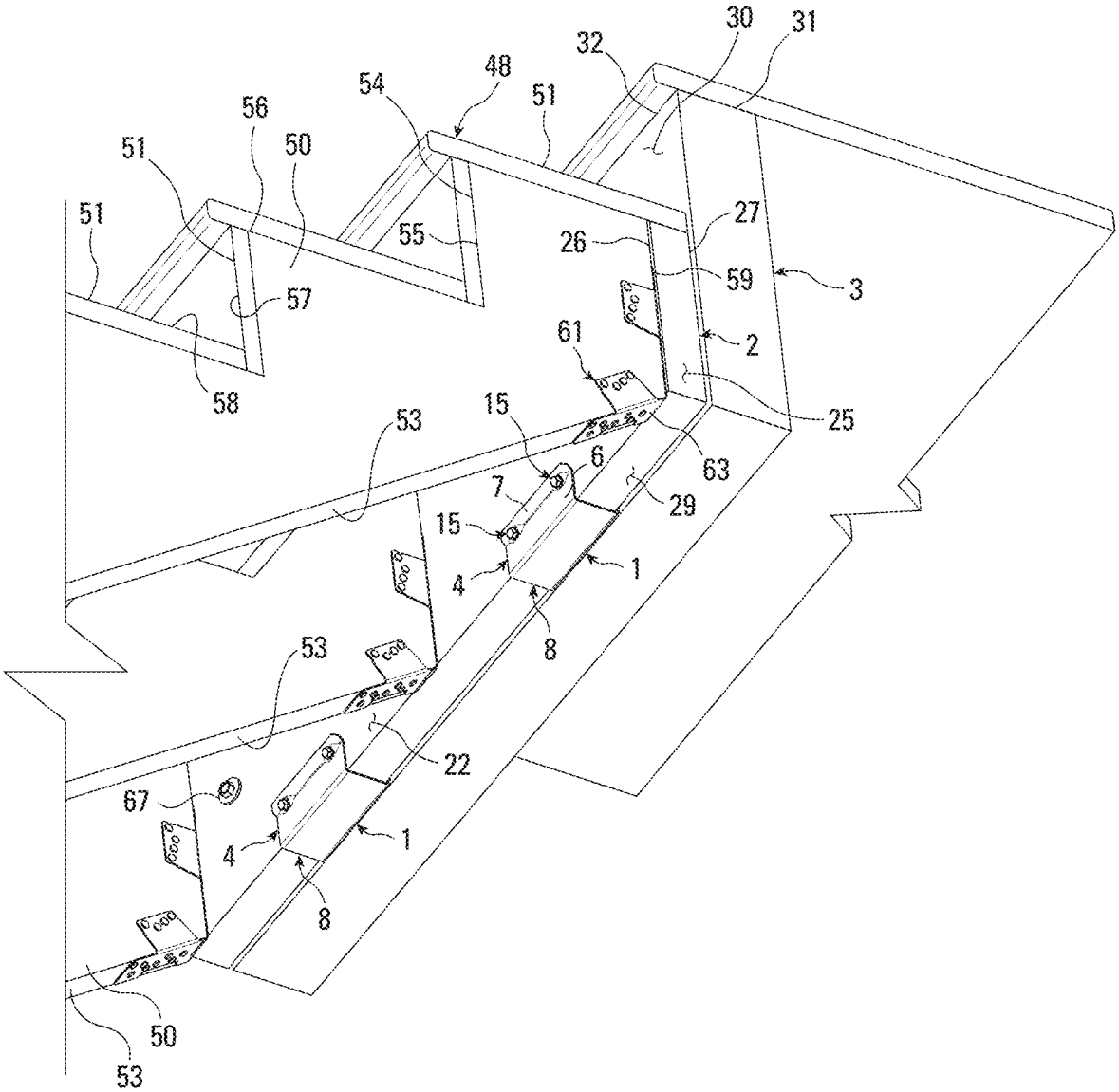
FIG. 11 is a bottom perspective view of the connection of the present invention.

As shown in FIGS. 8, 11 and 12, the supported member 2 is formed with front and back sides 22 and 23 that are generally parallel to each other and are spaced apart a first selected distance 24. The supported member 2 is also formed with an end face 25 that meets with the front and back sides 22 and 23 of the supported member 2 at front and back side edges 26 and 27 of the end face 25. As shown in FIG. 8 the supported member 2 can be formed with a top face 28 and a bottom face 29 that meet with the left and right sides 22 and 23 and the end face 25. As shown in FIG. 8, the top and bottom faces 28 and 29 are generally parallel with each other. As shown in FIG. 8, the supporting member 3 has an attachment face 30 and a top face 31 that meets the attachment face 30 at a top edge 32 of the attachment face 30. As shown in FIG. 8, the attachment face 30 is generally vertically disposed and the top face 31 of the supporting member 3 is generally horizontally disposed.

As shown, the connector 1 is formed with front and back members 4 and 5. The front and back members 4 and 5 are substantially planar members that are generally parallel to each other. The front and back members 4 and 5 are spaced apart from each other a sufficient distance to closely accept the supported member 2 between them. The front member 4 interfaces with front side 22 of the supported member and back member 5 interfaces with the back side 23 of the supported member 2. The front and back members 4 and 5 are each connected to the seat member 8, and the front and back member 4 and 5 are only connected to each other through the seat member 8. The seat member 8 is sufficiently strong to hold the front and back members 4 and 5 in their spaced relationship.

The connector 1 is preferably cut and formed from thin sheet steel using automated machinery.

The front member 4 preferably is formed with an upper portion 7 and a lower portion 6. The upper portion 7 of the front member is preferably formed as a jutting lip flange, and the lower portion 6 is formed as a generally planar member. The jutting lip flange has an upper edge 33.

The upper edge 34 of the lower portion 6 of the front member 4 is connected to the jutting lip flange 7 that extends outwardly and further away from the back member 5 than the generally planar lower portion 6 of the front member 4. The jutting lip flange 7 is preferably a planar member that preferably extends outwardly at a 45-degree angle to the generally planar lower portion 6 of the front member 4. The jutting lip flange 7 is attached to the lower portion 6 of the front member 4 at a bend line along the upper edge 34 of the lower portion 6 of the front member 4.

Preferably, fastener openings 19 are provided in the front member 4, and additional fastener openings 20 are also provided in the back member 5.

At the interface between the jutting lip flange 7 and the lower portion 6 of the front member 4 one or more gusset members 35 are provided that extend between the jutting lip flange 7 and the lower portion 6 of the front member 4. The one or more gusset members 35 have generally planar fastener receiving members 36 that extend outwardly and away from the generally planar lower portion 6 of the front member 4 at an angle of approximately 22.5 degrees. An opening 19 for receiving an angled fastener 15 is preferably formed in each fastener receiving member 36.

The fastener receiving members 36 of the gusset members 35 are preferably formed as rectangular members with upper and lower edges 37 and 38 and left and right side edges 39 and 40. The upper edges 37 of the fastener receiving members 36 connect to the jutting lip flange 6 and the lower edges 38 of the fastener receiving members 36 connect to the lower portion 6 of the front member 4.

The one or more gusset members 35 are preferably formed with triangular left and right end portions 41 and 42 that respectively connect the left and right side edges 39 and 40 of the generally planar fastening receiving members 36 to the jutting lip flange 7 and the lower portion 6 of the front member 4. The back member 5 is formed with a top edge 43, and the upper portion 13 is formed with left and right outer edges 44 and 45. The lower portion 6 of the front member 4 is preferably formed with left and right outer edges 46 and 47.

The seat member 8 is preferably 5 inches wide. The back member 5 is preferably 7 and 3/16 inches tall, and the front member is almost 2 inches tall. The space between the front and back members 4 and 5 is preferably 1 and 7/8 inches wide. Preferably six additional fastener openings 21 are formed in the upper portion 7 of the back member 5 with the highest fastener opening being 0.5 inches below the top edge 43 of the back member 5. The upper portion 7 of the back member 5 is preferably 2.75 inches wide. The left and right side angled fastener openings 19 are preferably formed in the front member 4 spaced between 0.5 inches and 1 inches, and in particular 0.813 inches, on center from the left and right outer edges 46 and 47 of the lower portion 6 of the front member 4. The left and right side angled fastener openings 19 are preferably formed in the front member 4 spaced between 0.125 inches and 0.5 inches, and in particular 0.313 inches from the left and right outer edges 44 and 45 of the upper portion 13 of the back member 5. The lower portion 6 of the front member 4 is preferably 1.5 inches tall, and the jutting lip flange extends approximately 0.5 inches from the upper edge 34 of the lower portion 6 of the front member 4. The angled fasteners 15 are preferably 3.5 inches long, 025 inch-diameter SDS screws made by Simpson Strong-Tie Company, Inc. The angled fasteners 15 enter the supported member 2 and the supporting member 3 at a 22.5 degree angle to the front side 22 of the supported member 2 and the attachment face 30 of the supporting member 3. The six additional fasteners 20 that go through the back member 5 and enter the supporting member 3 are preferably 10 d or 12 d nails and the fastener openings 21 that receive them are of a similar diameter as the nails.

As shown in FIGS. 8 and 11, the supported member or ledger 2 is preferably engineered wood lumber, such as laminated veneer lumber that is 1.75 inches wide, 9.6 inches tall and 4 feet and 3 inches wide and two connectors 1 are used to attach the ledger or supported member 2 to the header or supporting member 3. The supporting member or header 3 is also an engineered wood member that is 3.5 inches wide and 16 inches tall.

Figure 13:
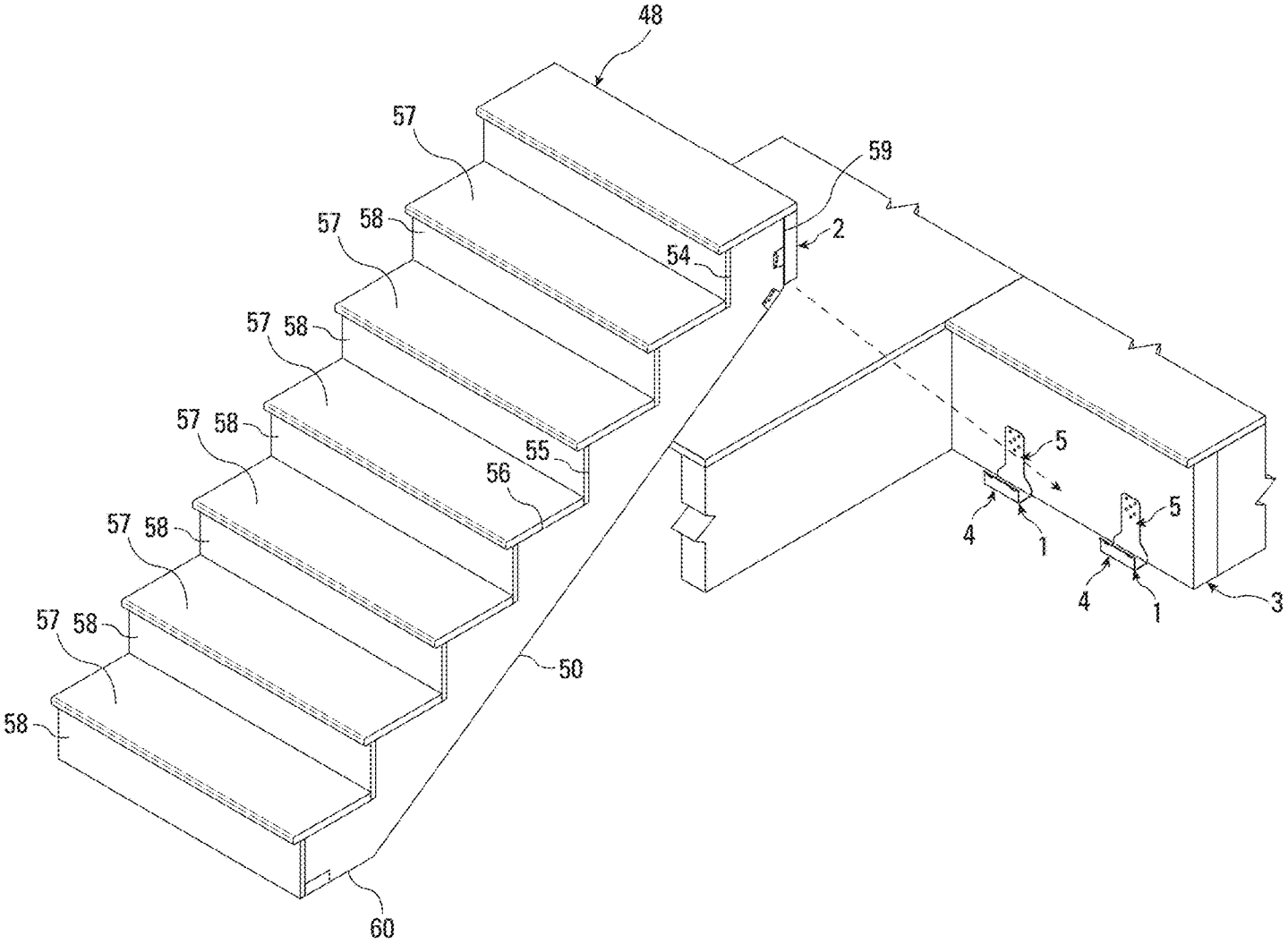
FIG. 13 is top perspective view showing the staircase cassette about to be placed in the connector which is already attached to the header.

The cassette 48 is preferably formed with a ledger 2, an opposed end board 49, and rim side boards or stringers 50 which are disposed at the periphery of the cassette. Preferably the ledger 2 is connected to the opposed rim side boards 50, and the end board 49 is also connected to the opposed rim side boards 50. The cassette 48 is provided with decking materials 51 that are connected to one or more of the ledger 2, opposed end board 49 and rim side boards 50. In the case of a staircase cassette 48 the rim boards are made up of stair stringers 50. As shown in FIGS. 8, 12 and 13, an additional member or stringer 52 is placed between the outer stair stringers 50 to provide additional support. If the cassette 48 was a planar member, the rim side boards 50 and one or more additional members 52 would be typical straight joists. As shown in FIG. 12, the stair stringers 50 and 52 are preferably formed with a straight bottom surface 53 while the top surface 54 is notched to form horizontal surfaces 55 that will serve as tread support surfaces, and vertical surfaces 56 that will form riser surfaces between the tread surfaces 55. As shown in FIG. 12, treads 57 and risers 58 are provided. At the upper end of the stair stringers 50 and 52 the stringer is cut to form a vertical rearward surface 59 that will interface with or lie closely adjacent to the ledger board 2. At the lower end of the stair stringers 50 and 52 the stinger is cut to form a horizontal downward facing surface 60 that can support the staircase cassette 48.

As shown in FIG. 8, the header 3 is substantially taller than the ledger 2.

As shown in FIGS. 8 and 12, the upper ends of the stair stringers 50 and 52 are connected to the ledger 2 with strap connectors 61. Preferably, the strap connectors 61 each have a back plate 62 that interfaces with or lies closely adjacent to the rearward surfaces 59 of the stair stringers 50 and 52. Fasteners are driven through the back plates 62 into the ledger 2. Connected to the back plates 62 are support plates 63 that interface with the bottom surfaces 53 of the staircase stingers 50 and 52. Support fasteners 64, which can be nails, are driven through support plates 63 and into the bottom surfaces 53 of the stringers 50 and 52. The strap connector 61 can have additional flanges 65 connected to the back plates 62 and support plates 63 that receive connection fasteners 66 which can be nails and which connect the strap connector 61 further to the stair stringers 50 and 52.

Figure 10:
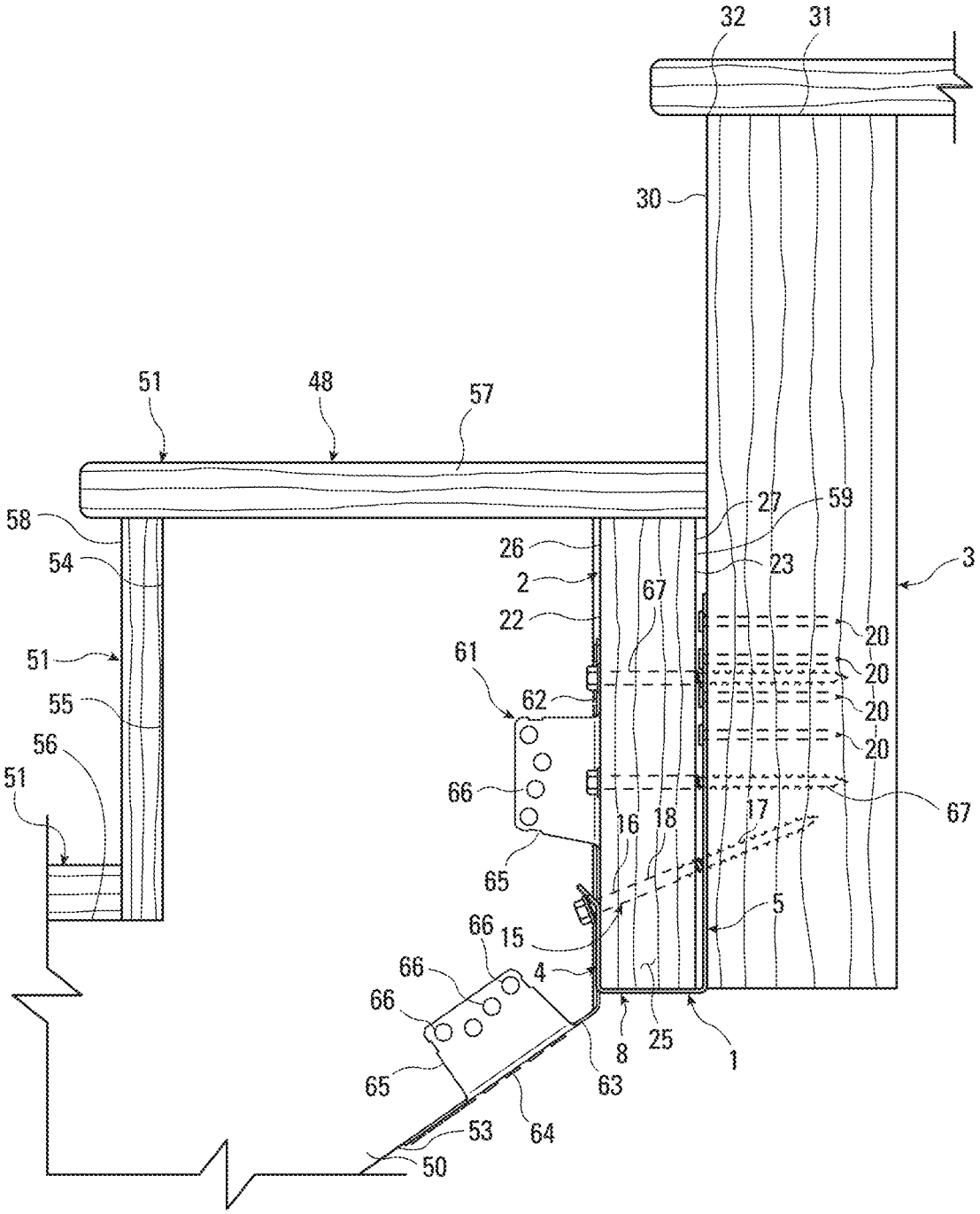
FIG. 10 is a right, side view of the connection of the present invention with additional fasteners connecting the ledger board to the header shown.

As shown in FIG. 10, additional ledger fasteners 67 which are preferably Simpson Strong-Drive SDS screws are driven through the supported member 2 into the supporting member 3 at spaced intervals along the length of the supported member 2. These ledger fasteners 67 do not pass through the connector 1.

As shown in FIG. 13, to make the connection between the cassette 48 and the header 3, first one or more connectors 1 are attached to the header 3 with the additional fasteners 20 that are driven through the back member 5 and into the header 3. Once the connectors 1 are in place, the cassette 48 will be lowered into the position.

Preferably, the cassette 48 is almost completely formed when it is lowered into place. The ledger 2, opposed end board 49, and rim side boards or stringers 50 are all connected in a manner that they are firmly set in position, and most of cassette 48 is provided with decking materials 51. Any additional members or stringers 52 are also attached to the cassette. According to the preferred method of installation, one or more of the uppermost treads 57 and risers 58 are not installed in the staircase cassette 48 before installation. The cassette is then lowered into place with the ledger 2 received between the front and back members 4 and 5 with the seat member 8 supporting the bottom surface 29 of the ledger 2. The installer then reaches through the stringers 50 and 52 and drives angled fasteners 15 through the front member 4 of the connector 1, through the supported member 2 and into the supporting member 3, preferably at the preferred 22.5 degree, upward angle. Preferably two angled fasteners 15 are used with each connector 1. For a typical staircase cassette 48 two such connectors 1 will be used. The installer then drives a plurality of connection fasteners 66 through the ledger 2 and into the header 3. The missing one or more treads 57 and risers 58 are then installed on the stringers 50 and 52. The bottom end of the staircase cassette 48 can also be connected to a support member at the bottom end.

We claim:

1. A connection between a supported member and a supporting member, the connection comprising:

a. the supported member, the supported member having front and back side faces that are generally parallel to each other and are spaced apart a first selected distance, the supported member also having an end face that meets with the back and front side faces of the supported member at front and back side edges of the end face, the supported member also having a top face and a bottom face that meet with the front and back side faces and the end face;

b. the supporting member, the supporting member having an attachment face with the back side face of the supported member being in close proximity to the attachment face such that the back side face of the supported member abuts or disposed in close association with the attachment face of the supporting member; and c. a connector, the connector having front and back members connected to each other at their bottom edges by a seat member with the front and back members extending upwardly from the seat member and the seat member supporting the bottom surface of the supported member and the front member of the connector being closely adjacent to the front side face of the supported member and the back member of the connector being closely adjacent to the back side surface face of the supported member, and the front member is formed with an upper portion and a lower portion, and the back member is formed with an upper portion, a middle portion and a lower portion, and the front and back members have portions that are generally planar, the seat member is generally planar, the back member extends above the seat member much higher than the front member, and when the connector is installed on the supporting member, the front and back members generally extend vertically, and the seat member extends generally horizontally, and the front member is substantially as wide as the seat member, and the middle portion of the back member is disposed upwardly from the seat member above the lower portion, and the upper portion of the back member is disposed above the middle portion, and the lower portion of the back member is substantially as wide as the seat member with the upper portion of the back member being narrower than the seat member and the front member; and d. at least two angled fasteners pass through the front member of the connector and the supported member and enter the supporting member to attach the connector and the supported member to the supporting member, and the at least two angled fasteners that pass through the front member of the connector and through the supported member and enter the supporting member are disposed at an upward acute angle to the seat member and enter the supporting member near the upper portion of the back member such that they bracket the upper portion of the back member without passing through the back member.

2. The connection of claim 1, wherein:

one or more additional fasteners pass through the back member and enter the supporting member.

3. The connection of claim 1, wherein:

the front member is a generally rectangular member.

4. The connection of claim 1, wherein:

the middle portion of the back member extends between the lower portion and the upper portion and tapers in width from the lower portion to the upper portion.

5. The connection of claim 1, wherein:

the upper portion of the back member has a bottom end and the bottom end of the upper portion and the interface between the middle portion and the upper portion of the back member is disposed above the seat member a distance that is similar to the height of an upper edge of the front member.

6. The connection of claim 5, wherein:

the front member is a generally rectangular member.

7. The connection of claim 5, wherein:

a. the middle portion of the back member extends between the lower portion and the upper portion and tapers in width from the lower portion to the upper portion.

8. The connection of claim 1, wherein:

the upper portion of the front member is formed as a jutting lip flange, and the lower portion of the front member is formed as a generally planar member, the jutting lip flange having an upper edge.

9. The connection of claim 8, wherein:

an upper edge of the lower portion of the front member is connected to the jutting lip flange, and the jutting lip flange extends outwardly and further away from the back member than the generally planar lower portion of the front member.

10. The connection of claim 9, wherein:

the jutting lip flange is a planar member that extends outwardly at a 45-degree angle to the generally planar lower portion of the front member.

11. The connection of claim 10, wherein:

the jutting lip flange is attached to the lower portion of the front member at an upper edge bend line of the lower portion of the front member.

12. The connection of claim 11, wherein:

one or more fastener openings are provided in the front member.

13. The connection of claim 12, wherein:

at an interface between the jutting lip flange and the lower portion of the front member one or more gusset members are provided that extend between the jutting lip flange and the lower portion of the front member.

14. The connection of claim 13, wherein:

the one or more gusset members have generally planar fastener receiving members that extend outwardly and away from the generally planar lower portion of the front member at an angle of 22.5 degrees, and each fastener receiving member is formed with at least one of the one or more fastener openings for receiving an angled fastener.

15. The connection of claim 14, wherein:

the fastener receiving members of the gussets are formed as rectangular members with upper and lower edges and right and left side edges, and the upper edges of the fastener receiving members connect to the jutting lip flange and the lower edges of the fastener receiving members connect to the lower portion of the front member.

16. The connection of claim 15, wherein:

the one or more gussets are formed with triangular left and right end portions that respectively connect the left and right side edges of the generally planar fastening receiving members to the jutting lip flange and the front member.

17. The connection of claim 16, wherein:

the front and back members and the seat member are formed from metal and are integrally joined to each other and are formed by bending sheet steel to make the three-dimensional shape of the connector.

18. The connection of claim 1, wherein:

a. the supported member is a ledger, and the ledger is part of a prefabricated member including additional members; and b. the supporting member is a header.

19. The connection of claim 18, wherein:

the prefabricated member is a cassette formed with the ledger, an opposed end board, and rim side boards which are disposed at the periphery of the cassette, and the cassette is provided with decking materials that are connected to the ledger, opposed end board and rim side boards.

20. The connection of claim 19, wherein:

the cassette is a staircase cassette, and the rim boards are sloped stair stringers formed with notches in their top surfaces.

* * * * *